United States Patent [19]

Togo et al.

[11] 3,950,589

[45] Apr. 13, 1976

[54] MELT-RESISTANT SYNTHETIC FIBER AND PROCESS FOR PREPARATION THEREOF

[75] Inventors: Masayuki Togo, Kyoto; Jiyuuro Takahashi, Otsu; Tamotsu Nakashima, Otsu; Shizuyoshi Ikenaga, Otsu, all of Japan

[73] Assignee: Toray Industries, Inc., Tokyo, Japan

[22] Filed: Feb. 8, 1973

[21] Appl. No.: 330,580

[30] Foreign Application Priority Data

Mar. 23, 1972 Japan ..... 47-28570

[52] U.S. Cl. ..... 428/394; 427/307; 427/377; 427/385; 428/395

[51] Int. Cl.[2] ..... B32B 27/42; D06M 15/54

[58] Field of Search..... 8/DIG. 18, 115.5, 190; 117/138.8 B, 138.8 F, 138.8 N, 138.8 UA, 139.5 CQ, 136, 47 A, 161 LN; 106/15 FP; 260/29.4, 29.2, 67.6 R; 427/307, 377, 385

[56] References Cited

UNITED STATES PATENTS

| | | | |
|---|---|---|---|
| 2,763,574 | 9/1956 | Ruperti | 117/103 |
| 2,859,136 | 11/1958 | Marsh et al. | 117/145 |
| 2,926,062 | 2/1960 | Gagliardi | 8/115.5 |
| 2,953,480 | 9/1960 | Burnell | 117/137 |
| 2,974,065 | 3/1961 | Mann et al. | 117/119.8 |
| 2,999,056 | 9/1961 | Tanner | 204/154 |
| 3,015,583 | 1/1962 | Vail et al. | 117/139.4 |
| 3,052,570 | 9/1962 | Polansky et al. | 117/139.4 |
| 3,087,837 | 4/1963 | Van Loo et al. | 117/139.4 |
| 3,138,802 | 6/1964 | Getchell | 2/243 |
| 3,163,556 | 12/1964 | Frotscher | 117/138.8 |
| 3,197,270 | 7/1965 | Roth | 8/115.5 |
| 3,378,397 | 4/1968 | Silvestri et al. | 117/139.4 |
| 3,383,240 | 5/1968 | Hirshfeld | 117/136 |
| 3,554,684 | 1/1971 | Emmons et al. | 8/116.2 |
| 3,617,193 | 11/1971 | Tesoro et al. | 8/116.2 |
| 3,660,303 | 5/1972 | Hiestand | 252/311.5 |
| 3,660,344 | 5/1972 | Michael et al. | 260/37 N |
| 3,778,226 | 12/1973 | Kissa | 8/115.5 |
| 3,785,861 | 1/1974 | Tanimura et al. | 117/138.8 B |
| 3,816,212 | 6/1974 | O'Brien | 156/331 |

*Primary Examiner*—P. E. Willis, Jr.

[57] ABSTRACT

A melt-resistant synthetic fiber is produced by adhering to said fiber a mixed aqueous solution of a melamine derivative compound and an acidic catalyst, and thereafter heat-treating in the presence of moisture, whereby the surface of said synthetic fiber is covered with a heat-resistant film.

12 Claims, 2 Drawing Figures

MELT-RESISTANT SYNTHETIC FIBER AND PROCESS FOR PREPARATION THEREOF

The present invention relates to a melt-resistant synthetic fiber such as polyamide, polyester, polyacrylonitrile and polyolefin having a heat-resistant surface film thereon which resists melting when heated.

DESCRIPTION OF THE PRIOR ART

In general, synthetic fibers have excellent properties in various respects as compared with natural fibers. However, some properties are still inferior to those of natural fibers, one of which is heat resistance.

For example, a natural fiber such as wool, silk or cotton, in fabric form, resists melting to form a hole when contacted at a point by a hot object having a temperature of 300° – 400°C for a few seconds. However, when the contact time becomes longer (at least 30 seconds), such a fabric carbonizes and forms a hole. On the other hand, a synthetic fiber melts (or decomposes) and forms a hole at a lower temperature than that of natural fibers by about 50° – 100°C. Such a difference in temperature of 50° – 100°C has given the public the impression that synthetic fibers have poor resistance to heat.

It is an object of this invention to eliminate such drawbacks of synthetic fibers and this object is accomplished by the present invention.

With the goal of imparting melt-resistance to synthetic fibers, it has heretofore been proposed to heat a synthetic fiber containing moisture in the presence of a triazine derivative compound and an acidic catalyst and to adhere said resin to the synthetic fiber to thereby impart heat-resistance to the fibers. However, when synthetic fibers are treated by this method, it is necessary to adhere a melamine derivative in an amount of at least 10% based on the weight of said fiber. When such a large amount of resin is adhered to the fiber, a clear dyed color effect cannot be obtained and the commercial value of the fiber is seriously affected, because the resinified matter formed on the fiber is white, which causes the dyed fiber to be dull in color. In order to overcome this drawback, it is necessary to make the amount of resinified matter less than 5% by weight, preferably less than 4% by weight. Then the color effect of the dyed fiber is not greatly impaired and the fiber becomes marketable, but then the melt-resistance then is not good.

Further, when the weight per unit area of a woven or knitted fabric is less than 150 g/m², good melt-resistance cannot be obtained, even when the adhered amount of resin is increased according to the prior art. Accordingly, it has been very difficult to impart a melt-resistant effect to merchandise of low weight per unit area (less than 150 g/m²). Further, in heat-treating, there is a tendency toward formation of water spots on the treated material due to drops of cohered moisture.

An object of the present invention is to eliminate the aforesaid difficulties and to provide many kinds of synthetic fibers having excellent melt resistance, and to provide processes for their preparation.

DETAILED DESCRIPTION OF THE INVENTION

Figure 1:
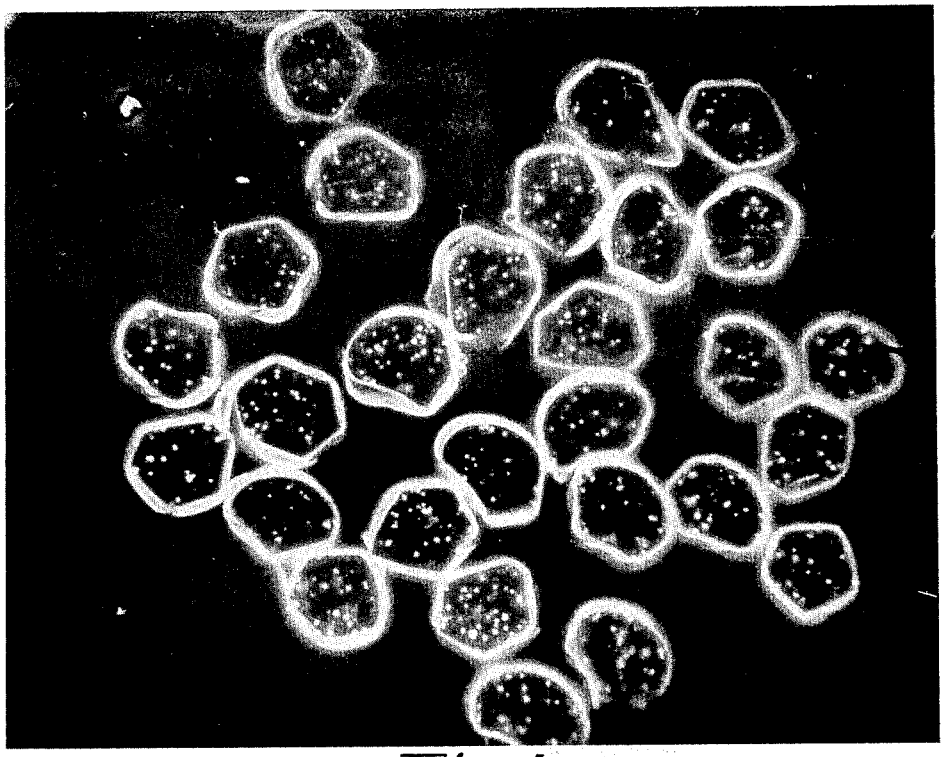

According to the present invention, a mixed aqueous solution of a specifically defined melamine derivative compound and an acidic catalyst are adhered to a synthetic fiber such as polyamide, polyester, polyacrylonitrile and polyolefin and thereafter the fiber is heat-treated in the presence of moisture.

Further, the present invention may include adhering to said synthetic fiber, a treating liquid, obtained by adding an ionic surface active agent to said mixed aqueous solution. The fiber may also be treated first with a solvent for said synthetic fiber.

In a melt-resistant synthetic fiber prepared by the process of the present invention, the surface area of a synthetic fiber, such as a polyamide, polyester, polyacylonitrile or polyolefin, is covered with a heat-resistant film having a depth or thickness of about 0.05 – 10 microns. This heat-resistant film consists of a nitrogen-containing compound deposited on or adhered to the fiber which is cross-linked two-dimensionally or three-dimensionally within the fiber substrate polymer. At the same time, a part of said compound is bonded to the fiber substrate polymer. The film per se does not show a melting point, but finally carbonizes under extreme heating. This film contains 0.2 – 20% by weight of nitrogen atom based on the weight of the fiber after carbonization.

Synthetic fibers according to the present invention, having such a film on the surface, develop excellent melt resistance and do not easily melt, even when contacted for several seconds with an object having a high temperature of 300° – 400°C.

The synthetic fibers referred to in the present invention include polyamides, polyesters, polyacrylonitriles and polyolefins. Said polyamides include nylon 6, nylon 66, nylon 12, nylon 4 and aromatic polyamides. The polyesters include polyester fibers such as ethylene glycol esters of phthalic acid, etc. The polyacrylonitriles include homopolymers and copolymers of polyacrylonitrile. Further, the polyolefins include polyethylene and polypropylene.

With this invention, it is possible to improve sharply the melt resistance of the filaments of any form of yarn, such for example as yarns made by blend spinning these polymers, or a core-sheath type or bimetal type composite yarn and composite filament which consists of a plurality of cores embedded in a matrix, said cores being extremely fine and parallel to each other along the fiber axis. Further, the process of the present invention can also be effectively applied to a product obtained from the aforesaid synthetic fibers.

When a conventionally prepared graft polymerized product, prepared from a monomer of the acidic vinyl series having a carboxyl group, is subjected to the process of the present invention, a melamine derivative compound combined in solution with an anion surface active agent is permeated into the graft polymer fiber substrate, where said compound cross-links with a carboxyl group in said fiber. Such a graft polymer fiber may, as compared with a fiber which has not been graft polymerized, be superior in melt resistance. The degree of improvement of the melt-resistant effect varies, depending upon the graft ratio and the amount of the cross-linked melamine derivative compound. Namely, when the graft ratio is 1 – 50%, the ratio of cross-linking is 0.1 – 50%, preferably 0.1 – 20%, and excellent melt resistance is developed.

As monomers of the acidic vinyl series containing a carboxyl group used for making graft polymerized synthetic fibers having such an excellent melt-resistant effect, acrylic acid, methacrylic acid, maleic acid, itaconic acid and fumaric acid are excellent examples.

Referring to such graft polymer synthetic fibers, 8% of acrylic acid has heretofore been graft polymerized to acrylic fibers. Thereafter, the product's melt resistance has been improved by converting to the sodium salt, and it is true that synthetic fibers obtained by this method have water-absorbing and hygroscopic properties which are about the same as those of cotton. Also, a very excellent antistatic effect is provided in the initial stage. However, when such synthetic fibers are washed just once, this effect disappears completely. This because such sodium salt is subjected to ion exchange with calcium ions in the wash water. As a result of many test runs, we have found that in the cases of salt bonding and salt cross-linking, it is not possible to maintain stability.

In contrast, the process of the present invention has an excellent effect because the bond between the carboxyl groups of the graft polymer fibers and the melamine derivative compound is not a salt bond, but is due to covalent cross-linking. Accordingly, ion exchange never takes place and the melt-resistant effect is never simply lost by exposure to a dilute acid or by washing repeatedly at home.

In referring to a melamine derivative compound as used in the present invention we refer to compounds represented by the following general formula (I)

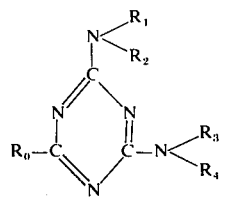

I wherein $R_0$ represents —H, —OH, $-C_6H_5$, $-C_{n_1}H_{2n_1+1}$ ($n_1$= 1 -10), $-COOC_{n_2}H_{2_{n_2}+1}$, ($n_2$=1 - 20), or $-CONR_5R_6$, $NR_5R_6$.

$R_1$ - $R_6$ each represents, the same or different, —H, —OH, $-OC_{n_3}H_{2_{n_3}}+1$, $-CH_2OCN_{n_3}H_{2n_3+1}$, $-CH_2NHCOC_{n_3}H_{2n_3+1}$, $-CH_2COOC_{n_3}H_{2n_3+1}$, ($n_3$= 1 - 20), $-CH_2OH$, $-CH_2CH_2OH$, $-CONH_2$, or $-CONHCH_2OH$, $-O(-O-X)_{n_4}R_7$, ($n_4$= 1 - 1500). X represents $C_2H_4$, $C_3H_6$, or $C_4N_8$, and $R_7$ represents —H, $-CH_3$, $-C_2H_5$, or $-C_3H_7$.

The useful concentration of these melamine derivative compounds is at least 0.5% by weight aqueous solution, preferably 1 - 20% by weight aqueous solution. The amount of resin adhered onto a synthetic fiber is at least 0.1%; preferably, however, the range is limited to 5% by weight in order to prevent the color from becoming dull.

As a catalyst for resinifying said melamine derivative compound, the following may be cited: aliphatic carboxylic acids such as formic acid and acetic acid, olefin carboxylic acids such as acrylic acid, saturated dicarboxylic acids such oxalic and succinic acids, oxycarboxylic acids such as malic acid and tartaric acid, aminocarboxylic acids such as glutamic acid, unsaturated dicarboxylic acids such as maleic acid, aromatic dicarboxylic acids such as phthalic acid and organic salts of these acids such as ammonium, sodium and potassium salts for example. Alternatively, one may use inorganic salts such as ammonium, sodium, magnesium, aluminium and zinc salts as well as double salts of these salts of sulfuric acid, persulfuric acid, hydrochloric acid, phosphoric acid and nitric acid. Each of these catalysts generates hydrogen ion in an aqueous solution and is used preferably in an amount of 0.01 - 10% by weight (based on the aqueous solution).

These melamine derivative compounds permeate into the fiber substrate, where they undergo a two-dimensional or three-dimensional cross-linking reaction and a part of any of these compounds chemically bonds to the fiber substrate. The film formed as a result, provides thermal properties which are entirely different from those of the fiber substrate, namely, peculiar properties of not showing a melting point, and in case the temperature becomes higher than the melt-resistant temperature, the film finally carbonizes. This change may be understood from the fact that when a melt-resistant polyester fiber as shown in FIG. 1 is treated with an alkali, the fiber dissolves completely and only the film remain.

In forming such a film, the cross-linking reaction, may be promoted by the addition of a diamine derivative compound such as urea, thiourea, formalin, a phenol compound, triazone compound, ethylene urea, glyoxal compound or uronic compound.

In order to permeate a melamine derivative compound into a synthetic fiber, various means are adopted. However, for obtaining a permeating depth of 0.05 - 10 microns, preferably 0.5 - 3 microns which is the thickness considered necessary to impart a melt-resistant effect, it is advisable to use concurrently heat impregnating and steam heating procedures.

The solubilizer or solvent for synthetic fibers referred to herein varies depending upon the composition of the synthetic fiber. For example, for polyamide, suitable solubilizers include formic acid, phenol, acrylic acid and an aqueous solution obtained by adding calcium chloride to an alcohol such as methanol or ethanol, as well as inorganic acids such as hydrochloric acid and sulfuric acid. For polyester, solubilizers include alkalis such as caustic potash and caustic soda, cation surface active agents and m-cresol. For polyacrylonitrile, dimethyl formamide, dimethyl sulfoxide and silver nitrate suffice. For polyolefin, tetralin is most useful in respect of solubility. These solubilizers vary somewhat by solubility, however, they are used either as aqueous solutions or as 100% solubilizers. When fibers to be treated are immersed in the bath and heat-treated at a predetermined temperature, sufficient solubilizing is achieved. It is sufficient for at least 0.1% of the original weight of the fiber to dissolve however, it is preferable that the dissolved weight be about 0.1 - 1% in case of polyamide, about 0.1 - 5% in case of polyester and about 0.1 - 3% (each based on the weight of the fiber) in cases of polyacrylonitrile and polyolefin.

The foregoing is an explanation with reference to dissolution or solvent pre-treatment of the fiber. However, according to the present invention, as will be mentioned later, synthetic fibers not subjected to dissolution treatment can be given excellent melt resistance by use of an anionic surface active agent. Still better results are obtained, due to a synergistic effect, if a synthetic fiber is subjected to both dissolution treatment and treated with an anionic surface active agent. Such treated fiber is especially good in respect to the fastness or durability of the treatment.

Said anionic surface active agents include the following: anionic surface active agents of the carboxylic acid series of soap and sarcosinate, of the sulfuric acid ester salt series such as higher alcohol sulfuric acid ester, sulphonated oil, sulphonated fatty acid ester and sulphonated olefin, of the sulfonic acid salt series such as alkylbenzenesulfonic acid salt, alkylnaphthalenesulfonic acid ester, reaction product of oleic acid chloride and N-methyl laurin (IGEPON T, manufactured by IG Farben of Germany), sulfosuccinic acid diester and lignin sulfonic acid salt, and of the higher alcohol phosphoric acid ester salt series and phosphoric acid ester series. As the properties of these anionic surface active agents, the range of about 0.001 – 10% by weight (aqueous solution), preferably about 0.1 – 1% by weight (aqueous solution) may be cited. Because nonionic surface active agents and cationic surface active agents tend to arrest the resinification of said melamine derivative compound, they are unsuitable for the present invention.

The mixed aqueous solution is caused to adhere to the dissolved or untreated surface of said synthetic fiber by immersing, applying or spraying. At that time, it is necessary to have moisture present in an amount of at least 25% by weight based on the weight of fiber in the synthetic fiber. When the moisture ratio is less than 25% by weight, the desired melt-resistant effect is not obtained. It is possible to achieve this object by heat-treating the synthetic fiber after adhering the aqueous solution thereto without drying at a temperature of 40° – 140°C and moisture of at least 40% relative humidity (RH) for 0.5 – 180 minutes. If the moisture is less than 40% RH, the melt-resistant effect obtained is not as great.

In the present invention, a synthetic fiber with remarkable melt resistance is obtained for the first time by having such technical structure as is mentioned above.

Even when said synthetic fiber is treated with a system which does not contain said anionic surface active agent among the composition of said treating liquid, it is possible to impart excellent melt resistance to a fiber. Namely, it is possible to make a mixed aqueous solution consisting of said melamine derivative compound and said acid catalyst adhere to said synthetic fiber after it is subjected to said dissolution treatment and subject said synthetic fiber to said heat treatment. This embodiment of the present invention and the functional effect according to this method will be shown in examples to be mentioned later.

The melt-resistant effect of the present invention is greatly dependent on the permeating distance of the melamine derivative compound as well as the content of said compound inside the fiber. By experiments, it has been found that a content of 0.2 – 20%, based on the weight of the fiber and calculated on the basis of the amount of nitrogen contained is sufficient. If this content is less than 0.2% the melt-resistant effect is inferior; on the other hand, while the melt-resistant effect is satisfactory when this content is 20%, it is industrially very difficult to permeate such large amount of said compound into the fiber.

The specific effects of the present invention are:

1. In contrast to the prior art, according to which at least 10% by weight of the adhered resin has been necessary, according to the process of the present invention, excellent melt resistance may be imparted when said amount is less than 5% by weight.

2. The color effect in a dyed product is not greatly impaired.

3. The wash fastness and dry cleaning fastness are excellent.

4. It is possible to impart excellent melt resistance to a woven or knitted fabric having a weight per unit area of at least 80 b/m$^2$, which has hitherto been impossible.

5. Water spotting of a treated fabric is prevented by the use of an anionic surface active agent.

The melt-resistant synthetic fibers of the present invention have a continuous heat-resistant film on the surface layer thereof. In these fibers there is no mutual action between fibers such as adhesion and cross-linking. Generally, adhesion with a resin between fibers does not improve the heat resistance of such synthetic fibers. However, fibers with a heat-resistant film on the surface thereof, or as taught in the present invention, can still be adhered to one another with a resin between fibers.

FIG. 1 is an enlarged photographic view of a cross sectional area of a polyester fiber having a heat-resistant film on the surface thereof. As seen in FIG. 1 a uniform, continuous film is formed on the individual filament of the yarn.

This heat-resistant film can be removed only by treating said synthetic fiber with sodium hydroxide.

Figure 2:
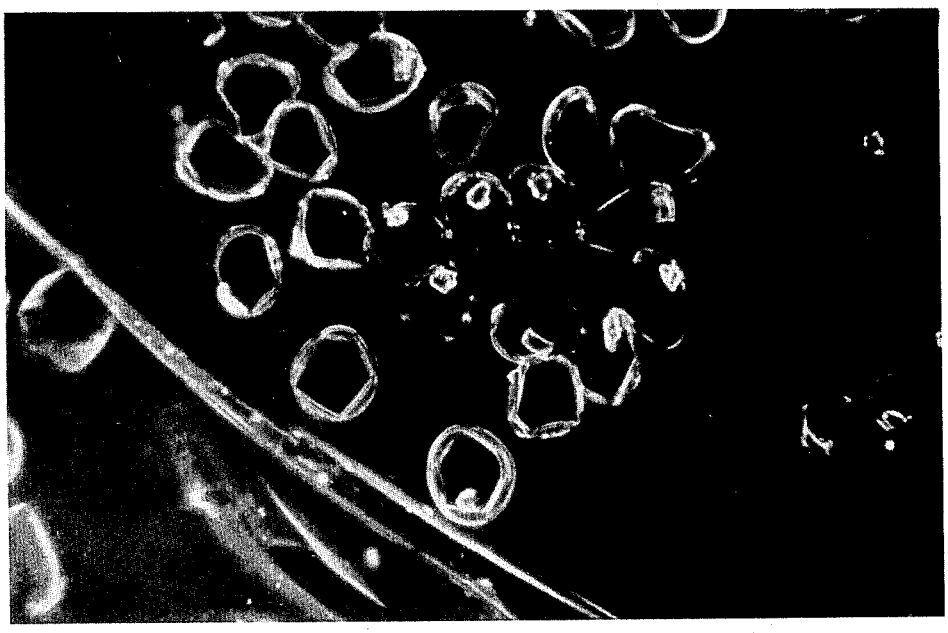

FIG. 2 shows the melt-resistant film only. The film of FIG. 2 is continuous and completely covers said fiber; this film which has very high heat stability, carbonizes at a temperature above 600°C. Further, the film exhibits no loss due to combustion.

In a hitherto existing fiber having a core and sheath structure, use of different polymers in the core portion and the sheath portion has been known. However, no such fiber is known in which the sheath portion comprises a heat-resistant resin film continuously formed. Thus the synthetic fiber of the present invention is completely novel.

The aforesaid effect of the present invention is not obtained by the prior art such as, for example, U.S. Pat. No. 3,137,802 which discloses imparting a water-soluble aminoplast to cotton. When said prior art is applied to polyester and polyamide, it results in increasing the melting point of these by at most 10°C. In contrast, when the technology of the present invention is applied, surprisingly the melting point is advanced by more than 100°C. The general effect of the present invention is to impart various excellent characteristics, as mentioned above, to a synthetic fiber. This is the first time such results have been reported. Such results are not seen in other known finishing technology. Comparative examples of the prior art are shown in Example 14. This example and the comparative examples cited therein permit one to compare directly and to further examine the difference between the present invention and the prior art in more detail. From these results, it is seen that the synthetic fiber of the present invention is not rough to the touch and the durability of the melt resistance imparted thereto is, at least, semipermanent.

The melt or heat resistance of synthetic fibers of the present invention is substantially better than that of natural fibers such as wool, silk and cotton. For example, when contacted with an object at a temperature of 400°C, holes are formed in natural fibers while no such melt holes are formed in the synthetic fibers of the present invention. Synthetic fiber treated in accordance with the present invention is expected to greatly expand the conventional scope of utilization of such fiber. This process may well be found very useful and practical for application on an industrial scale.

The present invention will be further described by reference to the following examples.

EXAMPLE 1

Using disperse dyestuff, a woven fabric of a polyester processed yarn having weight per unit area of 200 g/m² (grams per square meter) was dyed dark blue by a conventional method. To this dyed fabric, aqueous solutions of each of the compositions listed in Table 1 were made to adhere in an amount of 100% by weight (based on the fiber) to test fabric. Each of the treated fabrics was reacted at 105°C and a humidity of 100% RH for 15 minutes. The unreacted matter was washed off with soap and the test fabric was dried. The adhered ratio of resin was calculated by measuring the weight of the fabric before and after treatment. As to the color effect, L values were measured by a Hunter type color and color difference meter. With reference to the melt-resistant effect, each fabric was brought into contact under its own weight with a copper rod having a diameter of 8 mm heated to a predetermined temperature. Whether this caused a melt-hole upon contact was observed visually with the eye. The results of this test are shown in Table 1.

Table 1

| Sample No. | Resin Composition A | B | C | Adhered ratio of resin (%) | L value | Melt resistance |
|---|---|---|---|---|---|---|
| 1 | — | — | — | — | 15.8 | Melted and hole formed at 240°C |
| 2 | 4.8% | 1% | — | 2.9 | 16.8 | Melted and hole formed at 300°C |
| 3 | 10.0% | 1% | — | 6.5 | 17.4 | Melted and hole formed at 350°C |
| 4 | 15.0% | 1% | — | 12.3 | 19.1 | No melting or hole formed at 400°C |
| 5 | 4.8% | 1% | 0.3% | 3.1 | 16.4 | No melting or hole formed at 400°C |
| 6 | 10.0% | 1% | 0.3% | 6.7 | 17.5 | No melting or hole formed at 430°C |

NOTE:
A was melamine compound represented by the formula I (above) wherein each of $R_1$–$R_6$ was $CH_2OH$ and $R_0$ was $-NR_5R_6$
B was ammonium tartarate
C was $C_{12}H_{25}COONa$ As shown in Table 1, remarkable improvement in melt-resistance, due to the addition of an anionic surface active agent, was observed. As the L value increased, the color became whiter and depth of color disappeared. When the difference in the L value from the original (untreated) fabric was about 2 or lower, the commercial value of the fabric is not impaired. The cases of the contentional processes of Sample No. 2–4 was not satisfied with both the difference in L value and the melt resistance.

EXAMPLE 2

Using acid dyestuff, several test samples of a woven fabric of nylon 66 processed in accordance with the present invention were dyed dark brown by a conventional method. To this dyed fabric, an aqueous solution of each of the compositions shown in Table 2 was made to adhere in an amount of 100% by weight based on the fiber and the solution was resinified under conditions the same as those in Example 1. The treated fabrics were then washed with soap and dried and various characteristics were measured as indicated in Table 2.

Table 2

| Sample No. | Resin Composition A | B | C | Adhered ratio of resin (%) | L value | Melt resistance |
|---|---|---|---|---|---|---|
| 1 | — | — | — | 0 | 20.3 | Melted and hole formed at 240°C |
| 2 | 5% | 0.5% | — | 3.1 | 20.9 | Melted and hole formed at 300°C |
| 3 | 10% | 0.5% | — | 7.7 | 21.7 | No hole formed and no melting at 330°C |
| 4 | 5% | 0.5% | 1.0% | 3.2 | 21.4 | No hole formed and no melting at 330°C |
| 5 | 10% | 1.5% | 1.0% | 7.5 | 21.5 | No hole formed and no melting at 330°C |

NOTE:
A was a melamine compound represented by formula (I) wherein each of $R_1$, $R_3$ and $R_5$ was H, each of $R_2$, $R_4$ and $R_6$ was $CH_2OH$ and $R_0$ was $-NR_5R_6$.
B was a ammonium secondary phosphate
C was a $C_{12}H_{25}$—⟨benzene⟩—$SO_3Na$ As shown in Table 2, the melt resistance of the fibers was remarkably improved by the addition of an anionic surface active agent. As to the durability of the melt-resistant effects produced by these treatments, these effects were maintained through 50 home launderings. As to the problem of water spotting at the time of processing, no such spotting was observed in No. 4 and No. 5, whereas said spotting did occur at 2 and 3 places, respectively, in 30 meters of fabric in samples No 2 and No 3.

EXAMPLE 3

Using cation dyestuff, a knitted fabric of an acryl spun yarn, having a weight per unit area of 180 g/m², was dyed clear red. Aqueous solutions of each of several resin compositions as shown in Table 3 were made to adhere to samples of said dyed fabric by immersion. The amount of solution was 90% by weight based on the fiber, and each of the fabric samples with adhered solution was treated under conditions the same as those in Example 1. The ratio of adhered resin to fiber, the value and the melt resistance (which might well be called the decomposition resistance in the case of acryl), of each sample was tested with the results shown in Table 3.

Table 3

| Sample No. | Resin Composition A | B | C | Adhered ratio of resin (%) | L value | Melt resistance |
|---|---|---|---|---|---|---|
| 1 | — | — | — | 0 | 31.4 | Decomposed and hole formed at 270°C |
| 2 | 7% | 0.6% | — | 3.7 | 31.8 | Decomposed and hole formed at 320°C |

Table 3-continued

| Sample No. | Resin Composition A | B | C | Adhered ratio of resin (%) | L value | Melt resistance |
|---|---|---|---|---|---|---|
| 3 | 15% | 0.6% | — | 8.9 | 33.9 | No hole formed and no melting at 350°C |
| 4 | 7% | 0.5% | 0.5% | 3.9 | 32.1 | No hole formed and no melting at 350°C |
| 5 | 15% | 0.6% | 0.05% | 8.6 | 33.5 | No hole formed and no melting at 350°C |

NOTE:
A was a melamine compound represented by formula (I) wherein each of $R_1$, $R_3$ and $R_5$ was H, each of $R_2$, $R_4$ and $R_6$ was $CH_2OCH_2$ and $R_0$ was $-NR_5R_6$.
B was $(NH_4)_2SO_4$
C was $SO_3Na$— 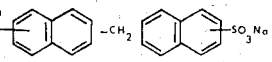

As shown in Table 3, even when the adhered ratio of resin was only one half the usual amount, good decomposition resistance was still developed. Because in the case of acryl, a clear color is obtained with the cation dyestuff, reduced L value indicate remarkably lowered commercial values. In this case, with an anionic surface active agent, small ratio of adhered resins was used, this minimizing the color effect of the melt resistance process and producing a product with at least potential commercial value.

EXAMPLE 4

From a polyester spun yarn, broadcloth fabric having a weight per unit area of 90 g/m² was woven. Said fabric was immersed in a 20% aqueous solution of caustic soda and treated at 98°C for 30 minutes. Thereafter, it was neutralized by acetic acid, washed sufficiently with water to remove residual alkali, and then dried. The weight loss was determined from the difference in weight of the fabric before and after treatment; it was 7.4% by weight. Next, using disperse dyestuff, samples of the fabric treated with the alkali and of the fabric not treated with alkali were dyed in blue by a conventional method. To each of these dyed fabric samples, an aqueous solution of each of the resin compositions listed in Table 4 was made to adhere, by an immersion technique, in an amount of 90% by weight. Before drying, the fabric samples were exposed to conditions of 98% relative humidity and a temperature of 108°C for 14 minutes to resinify the melamine compound. After the treatment, the unreacted matter was removed by washing with soap and the samples were dried. From the difference in weight of each of the fabric samples before and after the treatment, the ratio of adhered resin was sought. As to the color effect in these samples, this was tested by L value measurements using a Hunter type color and color difference meter. As to the melt resistance, a copper rod having a diameter of 8 mm was heated to a predetermined temperature, to the edge of which the treated fabric was contacted by its own weight for 5 seconds. Visual observation with the naked eye was used to determine whether the fabric melted at the point of contact or whether a hole was formed in the fabric. The results were as shown in Table 4.

Table 4

| Sample No. | Treatment with caustic soda | Resin Composition A | B | C | Adhered value of resin (%) | L value | Melt resistance |
|---|---|---|---|---|---|---|---|
| 1 | None | — | — | — | 0 | 32.6 | Melted and hole formed at 240°C |
| 2 | None | 4.8% | 0.5% | — | 2.8 | 33.4 | Melted and hole formed at 270°C |
| 3 | None | 12.0% | 0.5% | — | 7.8 | 34.9 | Melted and hole formed at 350°C |
| 4 | None | 4.8% | 0.5% | 0.5% | 2.9 | 33.1 | Melted and hole formed at 300°C |
| 5 | None | 10.0% | 0.5% | 0.5% | 6.6 | 34.2 | No hole formed and no melting at 350°C |
| 6 | Yes | 4.8% | 0.5% | — | 2.9 | 33.6 | Melted and hole formed at 300°C |
| 7 | Yes | 12.0% | 0.5% | — | 7.7 | 34.8 | No hole formed and no melting at 400°C |
| 8 | Yes | 4.8% | 0.5% | 0.5% | 2.9 | 34.1 | No hole formed and no melting at 350°C |
| 9 | Yes | 8.0% | 0.5% | 0.5% | 5.2 | 35.2 | No hole formed and no melting at 400°C |

NOTE:
A was melamine compound represented by formula (I) wherein each of $R_1$–$R_6$ was $CH_2OH$ and $R_0$ was $-NR_5R_6$.
B was ammonium oxalate.
C was $C_{12}H_{25}$— 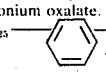 —$SO_3Na$ From the results in Table 4, it is seen that samples No. 8 and No. 9, which were first treated with alkali and then treated with a resin composition including an anionic surface active agent, showed good melt resistance to 350° – 400°C, better than that of any other samples by 50° – 100°C. For comparison, wool, which is a natural fiber, carbonizes at 330°C and formed melt holes. As to color effect, the difference in L values of the fabric before and after treatment should be about 1. Sample No. 8, with a difference of 0.5, is sufficiently good to be considered commercially acceptable. Other samples were unsatisfactory in either color effect or melt resistance or both. The melt resistance effect, imparted by the treatment of this invention, remained after 50 home washings or 20 dry cleanings.

EXAMPLE 5

From a nylon 66 spun yarn, a fabric having a weight per unit area of 110 g/m² was woven. Said woven fabric was immersed in a 10% aqueous solution of formic acid at 80°C for 5 minutes to dissolve the surfaces of the woven fibers. Weight loss, based on the difference in weight of the fabric before and after treatment, was 1.1%. Next, using acid dyestuff, untreated samples of this fabric and samples treated with formic acid, were dyed red by a conventional method. After dyed samples were dried, a sample of each was treated with an aqueous solution of one of the resin compositions listed in Table 5, 85% by weight of these compositions was adhered to separate samples by an immersion technique. Immediately thereafter, without being dried, each of these fabric samples were heat-treated under the conditions described in Example 4. Next, the treated fabrics were washed with soap and dried. The adhered ratios of resins, L values and melt resistance of these fabrics were measured and the results are shown in Table 5.

Table 5

| Sample No. | Treatment with formic acid | Resin Composition A | B | C | Adhered ratio of resin (%) | L value | Melt resistance |
|---|---|---|---|---|---|---|---|
| 1 | None | — | — | — | — | 28.7 | Melted and hole formed at 240°C |
| 2 | None | 4.8% | 0.6% | — | 3.1 | 29.4 | Melted and hole formed at 270°C |
| 3 | None | 15.0% | 0.6% | — | 12.7 | 31.9 | No hole formed and no melting at 330°C |
| 4 | None | 4.8% | 0.6% | 0.03% | 3.0 | 29.2 | No hole formed and no melting at 270°C |
| 5 | None | 10.0% | 0.6% | 0.03% | 6.6 | 30.5 | No hole formed and no melting at 330°C |
| 6 | Yes | 4.8% | 0.6% | — | 3.3 | 29.6 | No hole formed and no melting at 270°C |
| 7 | Yes | 10.0% | 0.6% | — | 6.1 | 30.3- | No hole formed and no melting at 350°C |
| 8 | Yes | 4.8% | 0.6% | 0.03% | 3.1 | 29.4- | No hole formed and no melting at 330°C |
| 9 | Yes | 8.0% | 0.6% | 0.03% | 6.5 | 30.4- | No hole formed and no melting at 360°C |

NOTE:
A was melamine compound represented by formula (1) wherein each of $R_1$, $R_3$ and $R_5$ was $CH_2OCH$, each of $R_2$, $R_4$ and $R_8$ was —H and $R_6$ was $—NR_7R_8$.
B was $NH_4NO_3$
C was $C_{12}H_{25}COONa$ In spite of the low weight per unit area, sample No. 8 had excellent melt resistance and practically unimpaired color effect.

EXAMPLE 6

A knitted fabric of a nylon 6 processed yarn was treated in a 2% aqueous solution of formic acid at 98°C for 20 minutes. Weight loss due to dissolution, measured by taking the difference in weight of the fabric before and after the treatment, was 0.2% by weight. Using acid dyestuff, samples of said fabric and samples of similar untreated fabric were dyed dark blue by a conventional method. To these samples of dyed fabrics, each of the resin compositions shown in Table 6 were made to adhere in an amount of 110% by weight based on the fiber, and, without drying, these samples were exposed to conditions of 100% relative humidity and a temperature of 110°C for 12 minutes to effect a resinification reaction. Next, each of the treated fabric samples were washed with soap. Using a non-ionic surface active agent, the unreacted matter was completely removed from these samples, which were then dried. The adhered ratio of resin on each fabric sample was calculated from the difference in weight of the fabric before and after the treatment with resin. As to the color effect, using a Hunter type color and color difference meter, L values were measured. For melt resistance, a copper rod heated to a predetermined temperature was contacted with each of the treated fabric samples under their own weight for 5 seconds. Whether the contacted portion melted and formed a hole was then observed with the naked eye. The results were as shown in Table 6.

Table 6

| Sample No. | Treatment with formic acid | Resin Composition A | B | Adhered ratio of resin (%) | L value | Melt resistance |
|---|---|---|---|---|---|---|
| 1 | None | — | — | — | 12.6 | Melted and hole formed at 220°C |

Table 6-continued

| Sample No. | Treatment with formic acid | Resin Composition A | Resin Composition B | Adhered ratio of resin (%) | L value | Melt resistance |
|---|---|---|---|---|---|---|
| 2 | None | 4.8% | 1% | 3.2 | 13.5 | Melted and hole formed at 300°C |
| 3 | None | 10.0% | 1% | 6.1 | 16.1 | Melted and hole formed at 330°C |
| 4 | None | 15.0% | 1% | 13.1 | 18.8 | No hole formed and no melting at 350°C |
| 5 | Yes | 4.8% | 1% | 3.4 | 13.4 | No hole formed and no melting at 330°C |
| 6 | Yes | 10.0% | 1% | 5.9 | 15.8 | No hole formed and no melting at 350°C |

NOTE:
A was melamine compound represented by formula (I) wherein each of $R_1$ – $R_6$ is $CH_2OH$ and $R_0$ was $-NR_5R_6$.

B was $NH_4Cl$

As shown in Table 6, even when the adhered ratio of resin was small, the formic acid treated synthetic fiber had excellent melt resistance, and because of the low adhered ratio of resin the L value was larger than the L value of untreated synthetic fiber by only 0.8. In general, when the difference between the L value of the untreated synthetic fiber and that of the treated synthetic fiber is about 1 or less, the treated synthetic fiber is not affected in respect of color.

The heat resistance of wool is in the vicinity of 330°C. In order to maintain heat resistance (melt resistance) similar to that of wool, the adhered ratio of resin of Sample No 4 would be required in the prior art while the adhered ratio of resins of Sample No. 5 is sufficient in the case of the product of the present invention. It should be noted that the L value of Sample No. 4, typical of the prior art, differred from the untreated standard by 6.2, which indicates that the color of dyed fabric was dull and such fabric could not be used for commercial merchandise.

EXAMPLE 7

A knitted fabric of a polyester spun yarn having weight per unit area of 350 g/m² was treated in a 7% aqueous solution of caustic potash at 100°C for 30 minutes. When the weight loss due to dissolution was measured by weighing the fabric before and after the treatment, it was 0.5% by weight. Using disperse dyestuff, said treated fabric and an untreated fabric were dyed in dark green by an established method. To each of the dyed fabrics, each of the aqueous solutions of various resin compositions for treating shown in Table 7 was made to adhere in an amount of 90% by weight based on the fiber, and each of the adhered fabrics was heat-treated under conditions similar to those of Example 6. Thereafter, the adhered ratios of resins, L values and melt resistance of these fabrics were measured. The results were as shown in Table 7.

Table 7

| Sample No. | Treatment with caustic potash | Resin Composition A | Resin Composition B | Adhered ratio of resin (%) | L value | Melt resistance |
|---|---|---|---|---|---|---|
| 1 | None | — | — | — | 24.9 | Melted and hole formed at 240°C |
| 2 | None | 4.8% | 1% | 3.1 | 25.4 | Melted and hole formed at 300°C |
| 3 | None | 10.0% | 1% | 6.6 | 27.1 | Melted and hole formed at 350°C |
| 4 | None | 15.0% | 1% | 12.7 | 29.2 | No hole formed and no melting at 400°C |
| 5 | Yes | 4.8% | 1% | 3.2 | 25.6 | No hole formed and no melting at 400°C |
| 6 | Yes | 10.0% | 1% | 5.9 | 26.7 | No hole formed and no melting at 430°C |

NOTE:
A was melamine compound represented by formula (I) wherein each of $R_1$, $R_3$ and $R_5$ was H, each of $R_2$, $R_4$ and $R_6$ was $CH_2OH$ and $R_0$ was $-NR_5R_6$.
B was $HCOONH_4$ As shown in Table 7, fabrics treated with caustic potash were improved in melt resistance by 80° – 100°C. In the case of Sample No. 5 the difference in L value was less than 1 and the color effect, due to the melt resistance treatment, was not impaired.

This improved melt resistance was maintained through the 50 home launderings or 20 dry cleanings.

EXAMPLE 8

A knitted fabric of a polypropylene processed yarn having weight per unit area of 150 m/g² (1) was immersed in a 100% tetralin solution and treated at 50°C for 30 minutes. The weight loss due to dissolution was 0.1%. The different samples of said fabric, aqueous solutions of various resin treatment compositions as shown in Table 8 were made to adhere in an amount of 90% by weight, based on the fiber, and the adhered fabric was heat-treated under conditions as described in Example 6.

Separately, a woven fabric of a polyacrylonitrile spun yarn having weight per unit area of 130 g/m² (2) was immersed in a 50% aqueous solution of dimethyl sulfoxide (DMSO) and treated at 80°C for 10 minutes. The weight loss due to dissolution at that time was 0.1%. To different samples of said fabric, aqueous solutions of various resin treatment compositions as shown in Table 8 were made to adhere in an amount of 90% by weight based on the fiber and the adhered fabric was heat-treated as described in Example 6. The results of measuring the adhered amount of resin and melt resistance of each of these two fabrics were as shown in Table 8.

As shown in Table 8, fabrics treated in accordance with the present invention exhibit excellent melt resistance as compared with untreated fabrics.

Table 8

| Fiber | Resin Composition A | Resin Composition B | Adhered amount of resin (%) | Melt resistance |
|---|---|---|---|---|
| 1 | — | — | — | Melted and hole formed at 170°C |
| | 10% | 1% | 10 | Melted and hole formed at 300°C |
| 2 | — | — | — | Melted and hole formed at 270°C |
| | 10% | 1% | 10 | Melted and hole formed at 360°C |

NOTE:
A was a melamine compound represented by formula (I) wherein each of $R_1$ – $R_6$ was $CH_2OH$ and $R_0$ was $—NR_6R_6$.

EXAMPLE 9

A 75 denier/36 filament nylon 6 filament yarn was false twisted and knitted into a fabric. After ordinary scouring, the knitted fabric thus obtained was immersed and graft polymerized in an aqueous solution containing 3% of acrylic acid, 0.05% of ammonium persulfate and 0.5% of formaldehyde sulfoxylic acid at 60°C for 30 minutes with stirring. When the graft ratio was determined by neutral titration, it was 21.0%.

Next, said fabric was immersed in an aqueous solution consisting of 2% of a melamine derivative represented by formula (I) wherein each of $R_1$, $R_3$ and $R_5$ was H, each of $R_2$, $R_4$ and $R_6$ was $—CH_2OCH_2$ and $R_0$ was $—NR_5R_6$ and 0.3% of a surface active agent, $C_{12}H_{25}COONa$, heated at 95°C for 20 minutes, and thereafter washed sufficiently with water to remove the treating solution and then dried. The cross-linked amount of said fabric was 18.5%.

For comparison, the graft polymerized fabric was heat-treated in a 1% aqueous solution of calcium carbonate to convert it to a calcium salt.

For a melt test, onto an iron pipe having a diameter of 2 cm and a height of 10 cm, a 3 cm thick iron plate was welded. On the peripheral surface of said cylinder, a nichrome electric heating wire was wound and temperature control was effected by a slyduck to make a melt resistance tester. Onto said iron plate heated to a predetermined temperature, a sample fabric was lightly contacted and the temperature at which it melted was observed. The results of testing in this manner are shown in Table 9.

Table 9

| Sample | Melting Observations: Original fabric | After washing | Treated with acetic acid |
|---|---|---|---|
| Nylon 6 | Melted at 220°C | Melted at 220°C | Melted at 220°C |
| Nylon 6 treated with melamine | Melted at 280°C | Melted at 220°C | — |
| Calcium salt after graft polymerization | Not melted at 400°C | Not melted at 400°C | Melted at 270°C |
| Treated with melamine after graft polymerization | Not melted at 400°C | Not melted at 400°C | Not melted at 400°C |

In said table, "after washing" refers to test results on fabrics after home washing each of the test samples 5 times, while "treated with acetic acid" are the results after immersing each of the test samples, home washed 5 times, in a 5% aqueous solution of acetic acid at room temperature for 2 minutes. As shown in Table 9, in the case of the untreated nylon 6 fabric, it completely melted at 240°C. In the case of the nylon 6 fabric treated with an aqueous solution of melamine, the melt resistance was as high as about 270°C, however, the effect disappeared upon washing and there was no durability. The fabric of nylon 6 made into a calcium salt after graft polymerization did not melt at 400°C, but became yellow; its fastness to washing was excellent. However, it melted when it was immersed in dilute acetic acid. Whereas, in the case of the fabric of the present invention treated with melamine after graft polymerization, its melt resistance was not lowered by washing and treatment with acetic acid, and did not melt at 400°C, but became yellow only.

EXAMPLE 10

A 75 denier/24 filament polyester (condensation product of terephthalic acid and ethylene glycol) yarn was false twisted and knitted into a fabric.

After ordinary scouring, said fabric was immersed in a dispersed aqueous solution, consisting of 5 parts of 200 mesh finely divided particles consisting of 36 parts of benzoyl peroxide and 64 parts of magnesium sulfate, 2 parts of a non-ionic surface active agent and 1000 parts of water, and heated at 80°C for 20 minutes to carry out an activating treatment. Thereafter, said fabric was washed with sufficient water to remove the remaining treating solution, dried by air and left to stand in a vapor obtained by heating a 50% aqueous solution of acrylic acid for 10 minutes to obtain a fabric having a graft ratio of 14.3%. The graft ratio was calculated from the weight of the sample before and after graft polymerization.

Next, the fabric was immersed in an aqueous solution containing 1% of the melamine derivative used in Example 9, 1% of magnesium chloride as a catalyst and 1% of sodium laruylbenzylsulfonate and heat treated at 100°C for 20 minutes.

Melt resistance tests of samples after being treated with melamine was carried out to obtain the results shown in Table 10.

Table 10

| Sample | Original fabric | After washing |
|---|---|---|
| Polyester | Melted at 240°C | Melted at 240°C |
| Polyester treated with melamine | Melted at 240°C | Melted at 240°C |
| Treated with melamine after graft polymerization | Not melted at 360°C | Not melted at 360°C |

EXAMPLE 11

Samples of the nylon 6 knitted fabric graft polymerized with 21% of acrylic acid obtained in Example 9 were heat-treated at 95°C for 20 minutes in an aqueous solution consisting of 2% of a melamine derivative represented by formula (I) wherein each of $R_1$ - $R_6$ was $CH_2OH$ and $R_0$ was $—NR_5R_6$ and 0.05% of sodium laurylcarboxylate.

As a comparative experiment, a sample of said fabric was also treated with an aqueous solution containing 15% of said melamine derivative and 0.1% of zinc nitrate was made to adhere by a mangle. This fabric was then dried at 100°C for 15 minutes and thereafter cured at 150°C for 3 minutes. The resultant fabric was remarkably hard in feel and not suitable for clothing.

Further, a sample treated with the melamine derivative instead of being dried and cured was heated with steam at 100°C for 10 minutes and then washed with water and dried.

Mest resistance tests of these three kinds of samples were conducted with results as shown in Table 11.

Table 11

| Treating method | Original fabric | After washing | Feel |
|---|---|---|---|
| Padding, drying and curing | Melted at 240°C | Melted at 240°C | Very hard |
| Padding with steam | Not melted at 360°C | Not melted at 360°C | Good |
| Immersion method | Not melted at 360°C | Not melted at 360°C | Good |

EXAMPLE 12

A 250 denier/84 filament polyester filament yarn consisting of polyethylene terephthalate was false twisted and thereafter woven into a fabric. Said fabric was scoured in a relaxed state by an established method and thereafter immersed in a 2%, by weight, mixed aqueous solution consisting of 10% by weight of hexamethylol melamine and 20% by weight of a terephthalic acid dimethyl ester emulsion (20% by weight). This fabric was heated at 94°C for 30 minutes with stirring and then heated in a heated vapor at 120°C for 10 minutes and subjected to soaping action at 80°C for 30 minutes using a 2 g/liter solution of a non-ionic surface active agent. Finally it was dried.

The warp of the woven fabric was taken out and a photomicrograph of its cross sectional area is shown in FIG. 1. The black spots inside the films are titanium oxide. The thickness of the melamine resin film at that time was found to be 2.8 microns and the nitrogen content of the fiber was 2.0% by weight.

Further, FIG. 2 is a photomicrograph of the cross sectional area of a yarn obtained by immersing the obtained fiber in a 60 g/liter 48° Be aqueous solution of sodium hydroxide and treating said fiber at 90°C for 90 minutes. As shown in FIG. 2, the polyester fiber dissolved and only the film remained. When a lighted cigarette was brought into contact with this film, the film did not melt at all, but carbonized instead and the film maintained its same form both before and after carbonization. Next, the fibers having films were brought into contact for 20 seconds with a plate heated to 440°C; the fibers did not melt and no hole was formed in the fabric. For purposes of comparison, when wool, cotton and untreated polyester fiber were treated in a similar manner holes were formed in both wool and cotton within 5 seconds, while the polyester fiber simply melted through and formed a hole at 250°C.

EXAMPLE 13

Example 12 was repeated using the following melamine derivative compounds, (A) - (F), respectively, instead of hexamethylol melamine.

A. Butylated methylol melamine

B. Methylated hexamethylol melamine

C. Methyltetramethylol melamine

D. Butyltetramethylol melamine

E.

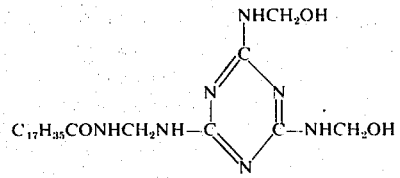

F.

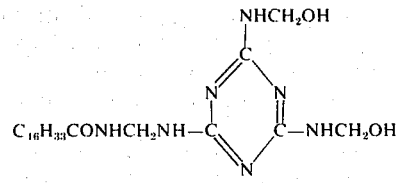

As a result, when said respective polyester fabrics treated with (A) - (F) were measured for melt resistance by the method described in Example 1, none of these fabrics melted or formed holes below 350°C.

COMPARATIVE EXAMPLE 1

A polyester spun yarn was woven into broad cloth having a weight per unit area of 90 g/m². This woven fabric was subjected to the following treatments, the results of which are shown in Table 12.

A: An aqueous solution consisting of 8.0% of a melamine derivative represented by formula (I) wherein each of $R_1$ – $R_6$ was $CH_2OH$ and $R_0$ was $—NR_5R_6$, 0.5% of ammonium oxalate and 0.5% of sodium dodecylbenzenesulfonate, was made to adhere to said fabric and the adhered fabric was wet heat-treated at 108°C for 14 minutes.

B: An aqueous solution consisting of 12% of methoxy trimethylol melamine and 1% of a 30% aqueous solution of hydrogen peroxide, was made to adhere to said fabric, and the treated fabric was film-sealed and treated at 30°C for 20 hours.

C: An aqueous solution consisting of 12% of methoxy trimethylol melamine and 0.4% of ammonium persulfate, was made to adhere to said fabric, and the adhered fabric was film-sealed and then heat-treated at 80°C for 15 minutes.

Table 12

| Treating method | Adhered amount of resins (%) | Melt resistance |
|---|---|---|
| A | 5.2 | No melt hole formed at 400°C |
| B | 2.0 | Melted at 270°C |
| C | 2.1 | Melted at 250°C |

As is apparent from Table 12, methods A, B and C were completely different in effect. Namely, the methods B and C were representative of the prior art; wherein melt resistance such as that imparted by method A was not imparted to the test fabrics.

COMPARATIVE EXAMPLE 2

In U.S. Pat. No. 3,138,802, a process is disclosed wherein a melamine compound and hydrogen peroxide are used in hardening a resin in a wet state.

With conditions the same as those in Example 1 of said U.S. Pat. No. 3,138,802, a mixed aqueous solution of hydrogen peroxide was made to adhere to a polyester woven fabric and a nylon 66 woven fabric, respectively, in an amount of 100%, each of the adhered fabrics was wound around a glass rod and treated at 30°C for 24 hours to cover the surfaces of the fabrics with a film. The unreacted matter was removed by washing with water and dried. As a result, the adhered ratio of resin was then 2.0% in the case of the polyester fabric and 0.3% in the case of the nylon 66 fabric. In melt-resistance, these fabrics were completely the same as untreated fabrics.

On the other hand, the effect of the present invention on cotton was examined. Namely, a mixed aqueous solution consisting of 10.0% of methylol melamine and 0.4% of ammonium persulfate was made to adhere to polyester, nylon 6 and cotton woven fabrics, respectively, and each of the adhered fabrics was treated in steam of 100% RH and 103°C for 5 minutes, washed with water and dried. The results of measuring the adhered ratios of resin and melt resistance as in Example 1 and observing under a microscope whether films were formed, are shown in Table 13.

Table 13

| Material | Adhered ratio | Melt resistance | Film formed or not |
|---|---|---|---|
| Polyester | 7.0% | more than 370°C | formed |
| Nylon 6 | 5.6% | more than 370°C | formed |
| Cotton | 6.4% | more than 370°C | not formed |
| Untreated cotton | — | more than 370°C | — |

As shown in Table 13, adhesion of the resin to cotton was observed by the process of the present invention. However, when the state or form of the resin adhered on the surface of cotton fiber was observed under a microscope, the resin was seen to adhere only intermittently and in a granular state. Formation of a film completely covering the fiber was not observed. In contrast thereto, in the cases of the fabrics of polyester and nylon 6, resin films completely covering the fabrics were observed.

COMPARATIVE EXAMPLE 3

In U.S. Pat. No. 3,197,270, a process is disclosed wherein nylon is treated in the presence of melamine resin and an acidic catalyst. Therefore, a comparative experiment was carried out with reference to the difference between the process of the present invention and that of U.S. Pat. No. 3,197,270.

Namely, according to U.S. Patent 3,197,270 a mixed aqueous solution consisting of 10% of methylol melamine and 1% of aluminium chloride is made to adhere to woven fabrics of polyester and polyamide, respectively, then each of the adhered fabrics are reacted at 98.9°C for 2.5 hours after. Fabrics treated in this manner were washed with water and dried. As a result of measuring the adhered ratio of the resin and the melt resistance of each of the fabrics as in Example 1, the adhered ratio of the resin on the polyester fabric was 8.5%, while said ratio on the polyamide fabric was 5.5%; however, the melt resistance of each of said fabrics was not greatly different from that of the non-processed fabric; thus melt resistance was not imparted to the test fabric. When the cross sectional area of the polyester fabric subjected to such treatment was observed under a microscope, resin existed only in gaps among the fibers and no films completely covering fibers, such as in the fabric treated by the process of the present invention, were observed.

What is claimed is:

1. A melt-resistant synthetic fiber having a surface layer portion consisting of a 0.05 – 10$\mu$ thick continuous heat-resistant film consisting of a cross-linked melamine derivative compound represented by the following general formula.

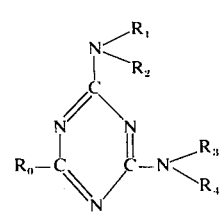

wherein $R_0$ is —H, —OH, $—C_6H_5$, $—C_{n_1}H_{2n_1+1}$, $—COOC_{n_2}H_{2n_2+1}$, $—CONR_5R_6$ or $—NR_5R_6$ $R_1 - R_6$ is —H, —OH, —$OCn_3H$ $2n_3+1$, —$CH_2OCn_3$ H $2n_3+1$, —$CH_2COOCn_3H$ $2n_3+1$, —$CH_2OH$, —$CH_2CH_2OH$, —$CONH_2$, —$CONHCH_2OH$, —O—(—OX-)$n_4$—$R_7$ or —$CH_2NHCOCn_3H$ $2n_3+1$ $R_7$ is —H, —$CH_3$, —$C_2H_5$or —$C_3H_7$ X is —$C_2H_4$—, —$C_3H_6$—, or $C_4H_8$— and $n_1$ is a number from 1–10, $n_2$ and $n_3$ are numbers from 1–20, and $n_4$ is a number from 1–1500.

2. Process for the preparation of a melt-resistant synthetic fiber which comprises adhering to a synthetic fiber a mixed aqueous solution of components (a), (b) and (c) where (a) is a melamine derivative compound represented by the following general formula:

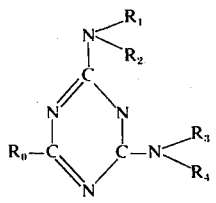

wherein $R_0$ is —H, —OH, —$C_6H_5$, $Cn_1H2n_1$ + 1, —$COOCn_1H2n_2$ + 1, —$CONR_5R_6$ or —$RN_5R_6$, $R_1$–$R_6$ is —H, —OH, —$OCn_3H2n_3$ + 1, —$CH_2OCn_3H2n_3$ + 1, —$CH_2COOCn_3H2n_3$ + 1, —$CH_2OH$, —$CH_2CH_2OH$, —$CONH_2$, —$CONHCH_2OH$, —O—(—OX)$n_4$—$R_7$ or $CH_2NHCOCn_3H2n_3$ + 1, $R_7$ is —H, —$CH_3$, —$C_2H_5$, or —$C_3H_7$—

X is —$C_2H_4$—, —$C_3H_6$—, or —$C_4H_8$— and $n_1$ is a number from 1 – 10, $n_2$ and $n_3$ are numbers from 1 – 20, and $n_4$ is a number from 1 – 1500, b. is an acidic catalyst selected from the group consisting of an inorganic acid selected from the group consisting of phosphoric acid, sulfuric acid, nitric acid, hydrochloric acid and persulfuric acid; an organic acid selected from the group consisting of olefin-monocarboxylic acid, saturated dicarboxylic acid, olefin-dicarboxylic acid, aromatic dicarboxylic acid, oxycarboxylic acid and aminocarboxylic acid; and the ammonium salt, alkali metal salt and alkali earth metal salt of said inorganic or organic acid, and c. is an anionic surface active agent represented by the following general formula:

$$R—COOX,\ R' — (SO_3X)n \text{ or } R'' — OSO_3X$$

wherein R is $Cm\ H_2m+1$,

R' is 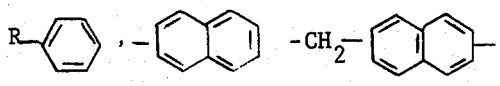

R'' is $C_8H_{17}$

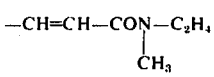

X is an alkali metal and $m$ is a number from 4 – 20 and $n$ is 1 or 2 depending on the number of bonds of R', heat-treating the adhered synthetic fiber in the presence of at least 25% by weight moisture based on the weight of said fiber, whereby the surface area of said synthetic fiber is covered with a heat-resistant film.

3. The process for the preparation of a melt-resistant synthetic fiber according to claim 2 wherein the fiber is first immersed in a solvent for said synthetic fiber and then heat-treated, the surface of said synthetic fiber being dissolved to the extent of at least 0.1% of the original weight of the fiber to promote the permeability of said fiber to melamine derivative compounds.

4. The process for the preparation of a melt-resistant synthetic fiber according to claim 3 wherein said fiber is polyamide and said solvent consists of one or more solvents selected from the group consisting of formic acid, phenol, acrylic acid, the reaction product of calcium chloride with methanol or ethanol, or sulfuric acid.

5. The process for the preparation of a melt-resistant synthetic fiber according to claim 3 wherein said fiber is polyester fiber and said solvent is selected from the group consisting of caustic potash, caustic soda, a cation surface active agent, m-cresol, and mixtures thereof.

6. The process for the preparation of a melt-resistant synthetic fiber according to claim 3 wherein said fiber is polyacrylonitrile and said solvent is selected from the group consisting of dimethyl formamide, dimethyl sulfoxide, and mixtures thereof.

7. The process for the preparation of a melt-resistant synthetic fiber according to claim 3 wherein said fiber is polyolefin and said solvent is teralin.

8. The process for the preparation of a melt-resistant synthetic fiber according to claim 2 wherein said heat-treatment is carried out in the presence of an environmental humidity of at least 40% relative humidity and at 40° – 140°C for 0.5 – 180 minutes.

9. The process for the preparation of a melt-resistant synthetic fiber according to claim 2 wherein said fiber includes acidic vinyl monomer graft polymerized thereon.

10. The process for the preparation of a melt-resistant synthetic fiber according to claim 9 wherein said acidic vinyl monomer is at least one member selected from the group consisting of acrylic acid and methyacrylic acid.

11. A process for the preparation of a melt-resistant synthetic fiber which comprises adhering to a synthetic fiber a mixed aqueous solution of components (a) & (b); wherein (a) is a melamine derivative compound represented by the following general formula:

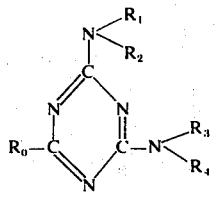

wherein $R_0$ is —H, —OH, —$C_6H_5$, —$Cn_1H2n_1+1$, —$COOCn_2H2n_2+1$ —$CONR_5R_6$, or —$NR_5R_6$, $R_1$ – $R_6$ is —H, —OH, —$OCn_3H2n_3$ + 1, —$CH_2OCn_3H2n_3$ + 1, —$CH_2COOCn_3H2n_3$ + 1, —$CH_2OH$, —$CH_2CH_2OH$, —$CONH_2$, —$CONHCH_2OH$, —O—(—OX)$n_4$ —$R_7$ or —$CH_2NHCOCn_3H2n_3$ + 1

$R_7$ is —H, —$CH_3$, —$C_2H_5$ or $C_3H_7$,

X is —$C_2H_4$—, —$C_3H_6$—, or —$C_4H_8$— and $n_1$ is a number from 1 – 10, $n_2$ and $n_3$ are numbers from 1 – 20 and $n_4$ is a number from 1 – 1500, b. is an acidic catalyst selected from the group consisting of an inorganic acid selected from the group consisting of phosphoric acid, sulfuric acid, nitric acid, hydrochloric acid and persulfuric acid; an organic acid selected from the group consisting of olefin-monocarboxylic acid saturated dicarboxylic acid, olefin-dicarboxylic acid, aromatic dicarboxylic acid, oxycarboxylic acid and aminocarboxylic acid; and ammonium salt, alkali metal salt or alkali earth metal salt of said inorganic or organic acid, and heat-treating the adhered synthetic fiber in the presence of at least 25% by weight moisture based on the weight of said fiber, whereby the surface area of said synthetic fiber is covered with a heat resistant film.

12. The process for the preparation of a melt-resistant synthetic fiber according to claim 11 wherein said moisture is provided by an environmental humidity of at least 40% relative humidity and said treatment is carried out at 40° – 140°C for 0.5 – 180 minutes.

* * * * *